United States Patent [19]

Onda et al.

[11] 4,221,111

[45] Sep. 9, 1980

[54] ELECTRONIC TIMEPIECE HAVING A VOLTAGE CONVERSION CIRCUIT

[75] Inventors: Mitsuo Onda; Singo Ichikawa, both of Tanashi, Japan

[73] Assignee: Citizen Watch Company Limited, Tokyo, Japan

[21] Appl. No.: 64,449

[22] Filed: Aug. 7, 1979

[30] Foreign Application Priority Data

Aug. 15, 1978 [JP] Japan ..... 53/99249
Jun. 12, 1979 [JP] Japan ..... 54/73833

[51] Int. Cl.[3] ..... G04B 19/24; G08B 21/00

[52] U.S. Cl. ..... 368/35; 340/752; 368/10; 368/66

[58] Field of Search ..... 58/4 A, 5, 23 R, 23 BA, 58/58, 152 A, 152 H; 340/636

[56] References Cited

U.S. PATENT DOCUMENTS 3,855,781 12/1974 Chihara et al. ..... 58/4 A 3,992,868 11/1976 Tamaru et al. ..... 58/58

*Primary Examiner*—Edith S. Jackmon

*Attorney, Agent, or Firm*—Jordan and Hamburg

[57] ABSTRACT

An electronic timepiece having a voltage conversion circuit for providing a different supply voltage from the timepiece battery voltage, detection means for detecting a condition in which a drive signal of relatively high voltage must be applied to an electromagnetic transducer of the timepiece, which is driven intermittently, switching means controlled by the detection means for selecting either the battery voltage or the converted voltage, and a circuit containing a capacitor which is charged by the output voltage of the switching means while the electromagnetic transducer is not being driven, and is discharged by supplying power to the transducer when the latter is driven, so that drive power is supplied to the transducer from, in effect, a low impedance source.

13 Claims, 6 Drawing Figures

ELECTRONIC TIMEPIECE HAVING A VOLTAGE CONVERSION CIRCUIT

BACKGROUND OF THE INVENTION

The present invention relates to an electronic timepiece having a voltage converter circuit whereby a different voltage from the battery voltage can be supplied to provide drive power for an electromagnetic transducer, and means whereby the supply of said different voltage is effectively performed irrespective of a high output impedance of the voltage converter circuit.

An electronic timepieces become of increasingly reduced size, it becomes ever more necessary to reduce the power consumption of these timepieces, so that it will be possible to utilize a battery of small size to provide power, while ensuring a sufficiently long lifetime for such a small size of battery. One method of achieving this objective, in the case of an electronic timepiece which utilizes an electromagnetic transducer consisting of a stepping motor to drive time display means, is to vary the level of the drive voltage applied to the electromagnetic transducer in accordance with particular operating conditions. Such operating conditions can include a need for a higher level of torque than is normally required from the transducer, such as when a calendar display mechanism is driven by the transducer to change the displayed calendar information. Other operating conditions can include an abnormal operating temperature, a drop in battery voltage, and so on. In the case of a timepiece having a display of days of the week and date information, provided by rotating days and date dials respectively, the load torque on the stepping motor is of the order of 0.1 gm cm, as measured at the minutes shaft of the timepiece, during normal driving of the hours and minutes display of current time. When the motor drives the days and date dials, however, the torque required is of the order of 0.3 to 0.5 gm cm (again, as measured at the minutes shaft). In order to provide a sufficient margin of torque to ensure reliable operation of the calendar display, it is usual practice in such a timepiece to provide the stepping motor with a torque of the order of 2 to 3 gm cm. In other words, a factor of safety of about 6 is allowed. This means, however, that during normal operation (i.e. when only the seconds, minutes and hours hands are being advanced), there is a factor of safety of the order of 20 to 30 provided. This results in an excessively high level of power being consumed by the motor during normal operation. Since the time during which the days and date dials are advanced is about ¼ of a day, i.e. about 6 hours per day, inefficient utilization of the battery is achieved. This runs counter to the objective of providing a battery of smaller size, and therefor smaller capacity, to enable a timepiece of compact size to be manufactured.

SUMMARY OF THE INVENTION

It is therefore an object of the present invention to provide an electronic timepiece in which the above disadvantages of the prior art are overcome.

More specifically, it is an obect of the present invention to provide an electronic timepiece incorporating means whereby the voltage supplied to power an electromagnetic transducer is varied to a suitable level in accordance with particular operating conditions of the timepiece, such as a requirement for an unusually high level of torque from the electromagnetic transducer.

BRIEF DESCRIPTION OF THE DRAWINGS

Further objects, features and advantages of the present invention may be understood from the following description, when taken in conjunction with the attached drawings. The scope claimed for the present invention is given in the appended claims.

In the drawings.

DESCRIPTION OF THE PREFERRED EMBODIMENTS

Figure 1:
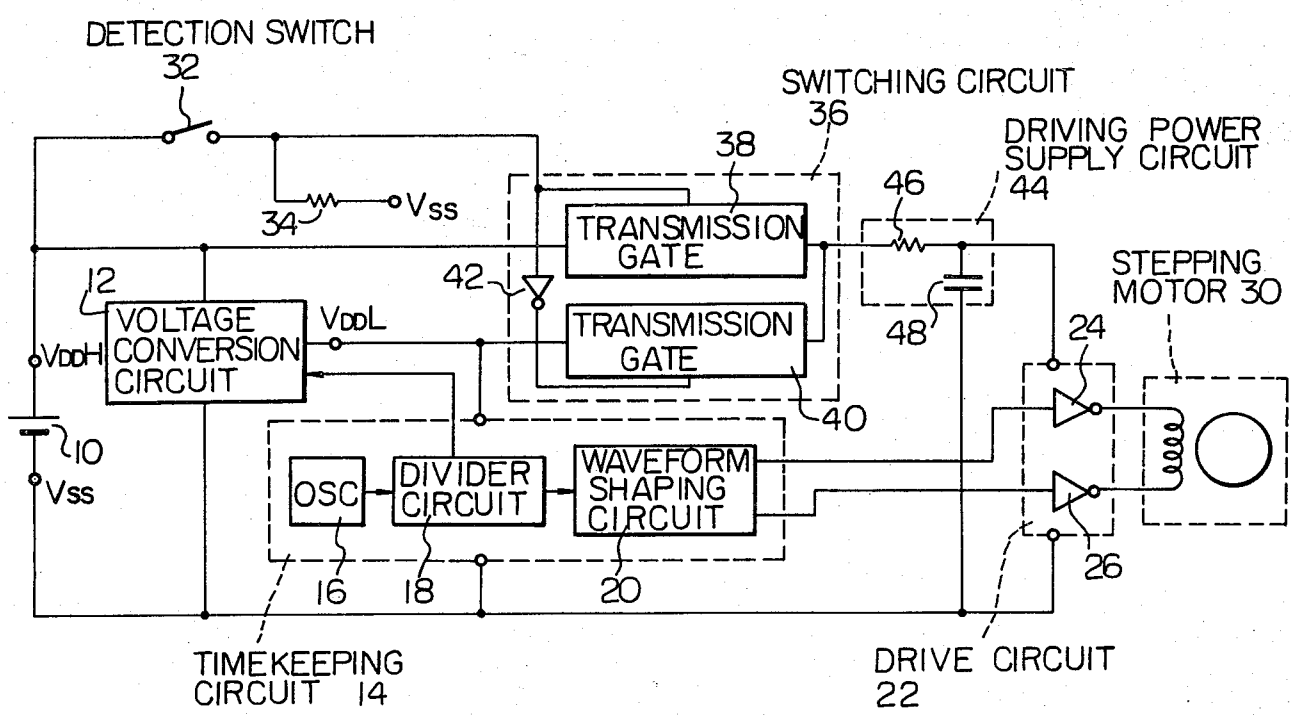
FIG. 1 shows a first embodiment of an electronic timepiece according to the present invention, having a detection switch to detect when a calendar display mechanism is about to be actuated.

Referring now to the drawings, FIG. 1 shows a first embodiment of an electronic timepiece according to the present invention. Power is supplied by a battery 10, to a voltage conversion circuit 12. The battery voltage is of the order of 3 V, for example, and the voltage conversion circuit 12 produces a converted supply voltage $V_{ddL}$ of about 1.5 V, which is supplied to a timekeeping circuit 14. Timekeeping circuit 14 comprises a quartz crystal controlled standard frequency oscillator circuit 16, which supplies a standard high frequency signal to a frequency divider circuit 18. The output from frequency divider circuit 18 is applied to a waveform shaping circuit 20, which thereby produces a standard time signal consisting of a train of pulses of consecutively alternating polarity, with the period between successive pulses being one second. The standard frequency signal is applied to a drive circuit 22, which thereby supplies a display drive signal to an electromagnetic transducer comprising a stepping motor 30, to advance the stepping motor once per second.

The stepping motor 30 drives time indicating hands, to indicate the hours and minutes of time, and a days dial and a date dial of a calendar display to indicate the day of the week and the date, (i.e. day of the month) through a wheel train which is not shown in FIG. 1.

The battery voltage is also applied to one input of a switching circuit 36, which consists of two transmission gates 38 and 40, and an inverter 42. Converted supply voltage $V_{ddL}$, whose magnitude may be of the order of one half the battery voltage, i.e. 1.5 V, is supplied to timekeeping circuit 14, and is also applied to one input of switching circuit 36. Numeral 32 denotes a detection switch 32, which is actuated by a cam arrangement in the wheel train which is coupled to stepping motor 30, as described hereinafter. Detection switch 32 is closed at a point in time prior to the days dial or date dial of the timepiece being advanced by stepping motor 30 through the wheel train, and remains closed until such advancement has been completed. When detection switch 32 is closed, then the high potential $V_{ddH}$ of the battery is applied to the control input of switching circuit 36, thereby causing the battery voltage $V_{ddH}$ to be applied directly to a driving power supply circuit composed of a charge-discharge circuit 44, through transmission gate 38. Prior to detection switch 32 being closed, i.e. during normal operation of the timepiece in which only the time indicating hands are actuated by stepping motor 30, the low potential of battery 10, $V_{ss}$ is applied to the control input of switching circuit 36. In this case, transmission gate 40 is enabled, so that the converted supply voltage $V_{ddL}$ from voltage conversion circuit 12 is supplied to charge-discharge circuit 44. The output voltage from charge-discharge circuit 44 is supplied to drive circuit 22, to provided power thereto.

The operation of the circuit of FIG. 1 will now be described. First, in the normal operating state, in which only the time indicating hands are actuated once per second by stepping motor 30, switching circuit 36 applies the converted supply voltage $V_{ddL}$, which is about 1.5 V, to the input of charge-discharge circuit 44. Charge-discharge circuit 44 consists of a resistor 46 which is connected to a capacitor 48. The output impedance of voltage conversion circuit 12, which utilizes field-effect transistor elements, is relatively high, by comparison with the impedance of battery 10. Thus, if the output voltage $V_{ddL}$ from voltage conversion circuit 12 were applied directly to supply drive circuit 22, there would be insufficient drive current available to operate stepping motor 30. In addition, the resultant drop in the level of output voltage from voltage conversion circuit 12 each time a standard time signal pulse is applied to stepping motor 30 could result in erratic operation of the timekeeping circuit 14. These difficulties are overcome by the use of charge-discharge circuit 44. During the intervals between standard time signal pulses, capacitor 48 is charged through resistor 46, from the output of voltage conversion circuit 12. When a standard time signal pulse is applied to drive circuit 22, then current is supplied to drive circuit 22 from the capacitor 48, at a low impedance level. Sufficient drive current from drive circuit 22 to actuate stepping motor 30 is thereby assured. In addition, due to the inclusion of resistor 46, any change in the voltage across capacitor 48 while a standard time signal pulse is occurring can have no effect upon the operation of timekeeping circuit 14, since such changes in capacitor voltage are isolated from the timekeeping circuit 14 by resistor 46 of the charge-discharge circuit 44.

Thus, during normal operation of the timepiece, both the timekeeping circuit 14 and drive circuit 22 are supplied with the converted supply voltage from voltage conversion circuit 12, which is lower than the battery voltage. Under this condition, the circuit component values are selected such that sufficient drive current is supplied to stepping motor 30 for the purpose of advancing the time indicating hands, with a margin of safety being allowed over the minimum drive current required for this purpose.

At a point in time shortly prior to a days dial or date dial being advanced by stepping motor 30, detection switch 32 is closed, as stated hereinabove. Voltage $V_{ddH}$ is thereby applied to the control input of switching circuit 36, causing the output of voltage conversion circuit 12 to be disconnected from charge-discharge circuit 44, and causing the battery voltage $V_{ddH}$ to be applied to charge-discharge circuit 44 through transmission gate 38. As a result, capacitor 48 is charged through resistor 46 to voltage $V_{ddH}$ of the battery 10, i.e. to about twice the voltage level to which capacitor 48 is charged during normal operation. Thus, the next standard time signal pulse applied to drive circuit 22 causes a larger current to flow into the windings of stepping coil 30 than would flow during normal operation. Sufficient torque is thereby developed by stepping motor 30 to drive the calendar display mechanism of the timepiece to advance the calendar information displayed thereby, with a sufficient margin of safety being allowed in this case, as in the case of normal operation. Subsequently, when the condition of advancement of the calendar display has ended, detection switch 32 is once more opened, so that the battery voltage $V_{ddH}$ is disconnected from charge-discharge circuit 44 by switching circuit 36, and voltage $V_{ddL}$ from voltage conversion circuit 12 is again applied to charge capacitor 48 through resistor 46.

It can thus be seen that this embodiment of the present invention permits the current which is drawn by stepping motor 30 to be set to a suitable value both during normal operation of the timepiece and when actuation of the calendar mechanism is performed by stepping motor 30. The problem of excessive current being supplied to the motor 30 during normal operation, in order to ensure that sufficient torque is available to actuate the calendar mechanism, is thereby overcome. Since the minimum possible current is thus drawn from battery 10 under all conditions of operation, it is possible to extend the operating lifetime of battery 10, as compared with a conventional electronic timepiece having a calendar information display driven by a stepping motor, or to utilize a smaller size of battery, thereby enabling the dimensions of the timepiece to be reduced.

Figure 2:
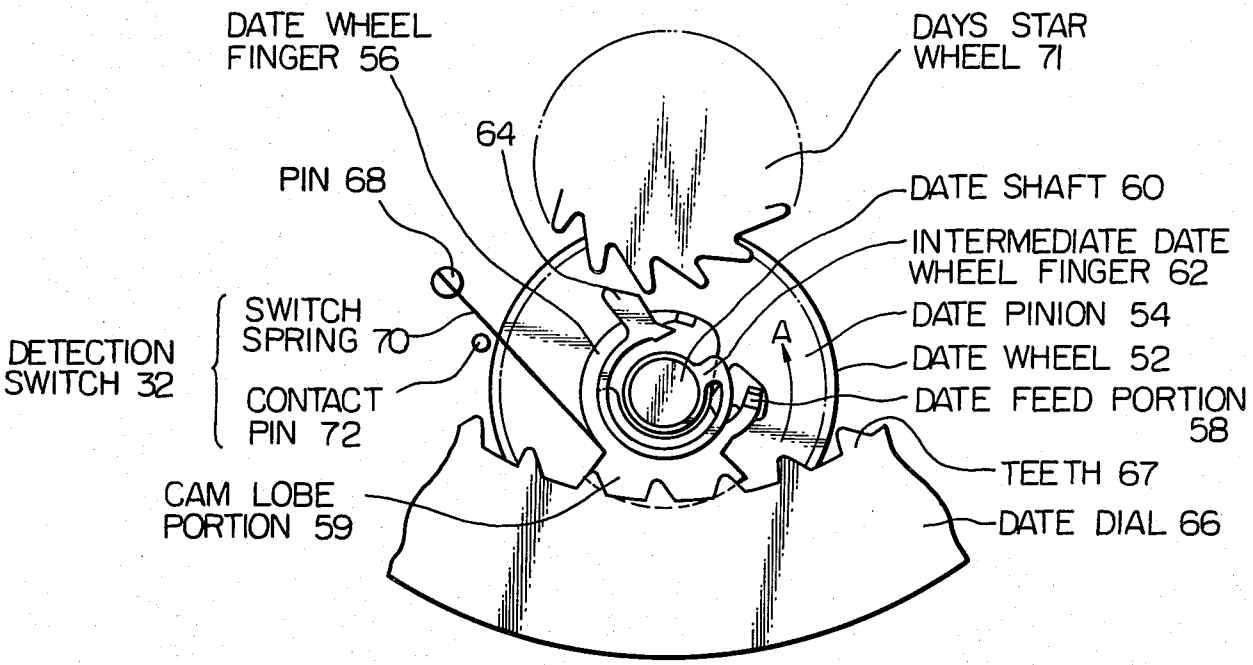
FIG. 2 shows an embodiment of a wheel train and cam arrangement to operate the detection switch of the embodiment of FIG. 1.

Referring now to FIG. 2, an embodiment of a wheel train coupled to the stepping motor 30 of the embodiment of FIG. 1 is shown in a partial view. Numeral 66 denotes a portion of a date dial of the timepiece (not shown in the drawing), whereby the days of the month are indicated. Numeral 71 denotes a days star wheel, which is rigidly attached to a days dial (not shown in the drawing) whereby the days of the week are indicated. In an electronic timepiece having a calendar display, such a days dial and date dial are both advanced once per day, generally at about midnight. Numeral 52 denotes a date wheel, comprised of a date pinion 54 press-fitted to a date shaft 60, and a date wheel finger 56 which is made of a high polymer material and is press-fitted to date pinion 54, together with an intermediate date wheel finger 62 which is also made of a high polymer material and is mounted on date shaft 60 to be rotated thereby. Intermediate date wheel finger has a flexible construction. Date wheel 52 is meshed with an hour wheel, which is not shown in the drawing.

Date wheel finger 56 has a date feed portion 58, which engages with the teeth 67 of date dial 66, and also has a cam lobe portion 59 which engages with one end of a metallic switch spring 70. The other end of switch spring 70 is rigidly fixed to a pin 68 which is affixed to a plate (not shown in the drawing). A metallic contact pin 72 is also affixed to the plate, at a short distance away from switch spring 70. Contact pin 72 is insulated from the plate, which is connected to one terminal of a battery, and is connected to circuitry such as is shown in FIG. 1 above. Contact spring 70 in conjunction with contact pin 72 constitute a detection switch, corresponding to detection switch 32 of the circuit of FIG. 1. Cam lobe 59 is mounted in the same plane as contact spring 70, so as to engage contact spring 70 as the date wheel 52 rotates.

In the status shown in FIG. 2, the cam lobe portion 59 has just come out of engagement with contact spring 70, so that advancement of the calendar information has just been completed. As date wheel 52 continues to rotate, portion 64 of intermediate date wheel finger 62 engages with contact spring 70. However, due to the flexible construction of the intermediate date wheel finger 62, contact spring 70 is not pushed into contact with the contact pin 72 at this time. As the date wheel 52 rotates further, cam lobe 59 engages the contact spring 70, causing contact spring 70 to touch contact pin 72. This corresponds to closing of the detection switch 32 shown in FIG. 1. Shortly thereafter, portion 58 of date wheel finger 56 engages with one of the teeth 67 of date dial 66, and thereby advances the date dial 66. A short time later, the portion 64 of intermediated date wheel finger 62 engages with days star wheel 71, and thereby advances the days dial of the timepiece. Shortly after this advancement of the days dial has been completed, cam lobe 59 disengages from contact spring 70, so that detection switch 32 is opened once more.

Figure 3:
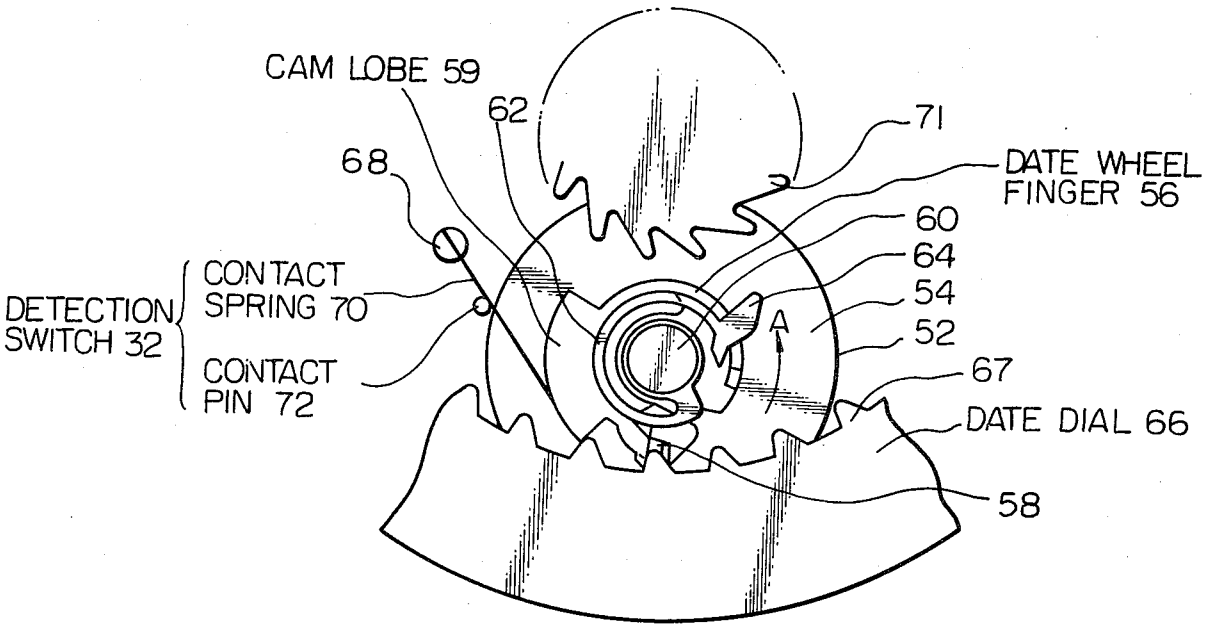
FIG. 3 is a drawing to illustrate the operation of the wheel train and cam arrangement of FIG. 2.

The above sequence of events is completed once in every 24 hours. FIG. 3 illustrates the point in the above sequence of events at which cam lobe 59 has closed switch 32, by pushing contact spring 70 against contact pin 72, and date dial 66 is being advanced by portion 58 of date wheel finger 56.

Figure 4:
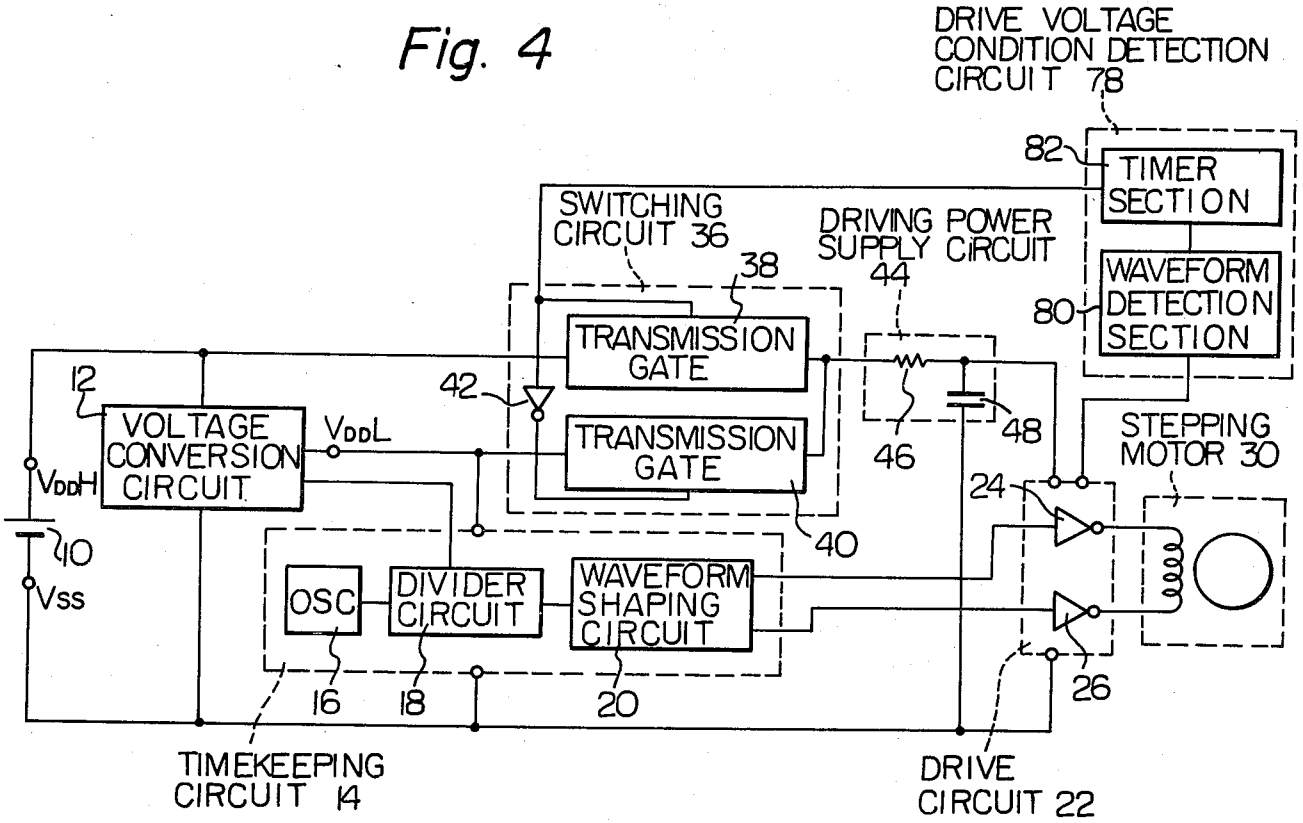
FIG. 4 shows a second embodiment of the present invention, in which a charge in the drive voltage applied to a stepping motor due to increased load is detected.

Referring now to FIG. 4, a second embodiment of an electronic timepiece according to the present invention is shown. In this drawing, parts having the same function as those of the embodiment of FIG. 1 are indicated by the same reference numerals. Numeral 82 denotes a drive voltage condition detection circuit, connected to drive circuit 22. Drive voltage condition detection circuit 78 consists of a waveform detection section 80 and a timer section 82. Waveform detection section 80 monitors the waveform of the drive signal produced by drive circuit 26. When a change in the drive waveform is detected which indicates a heavy load applied to the transducer 30, then a signal is applied from waveform detection section 80 to timer section 82. In response, timer section 82 produces a control signal for a predetermined time duration, which is applied to the control input of switching circuit 38. As a result, switching circuit 88 connects the voltage of battery 10 to charge-discharge circuit 44, and disconnects the output of voltage conversion circuit 12 from charge-discharge circuit 44, so that a higher voltage is supplied to drive circuit 22. This ensures that sufficient torque is developed by stepping motor 30 to deal with the increased load thereon, which has been detected by drive voltage condition detection circuit 82. This increased load can result from, for example, the need to advance a calendar display mechanism, as in the case of the embodiment of FIG. 1 above.

Figure 5:
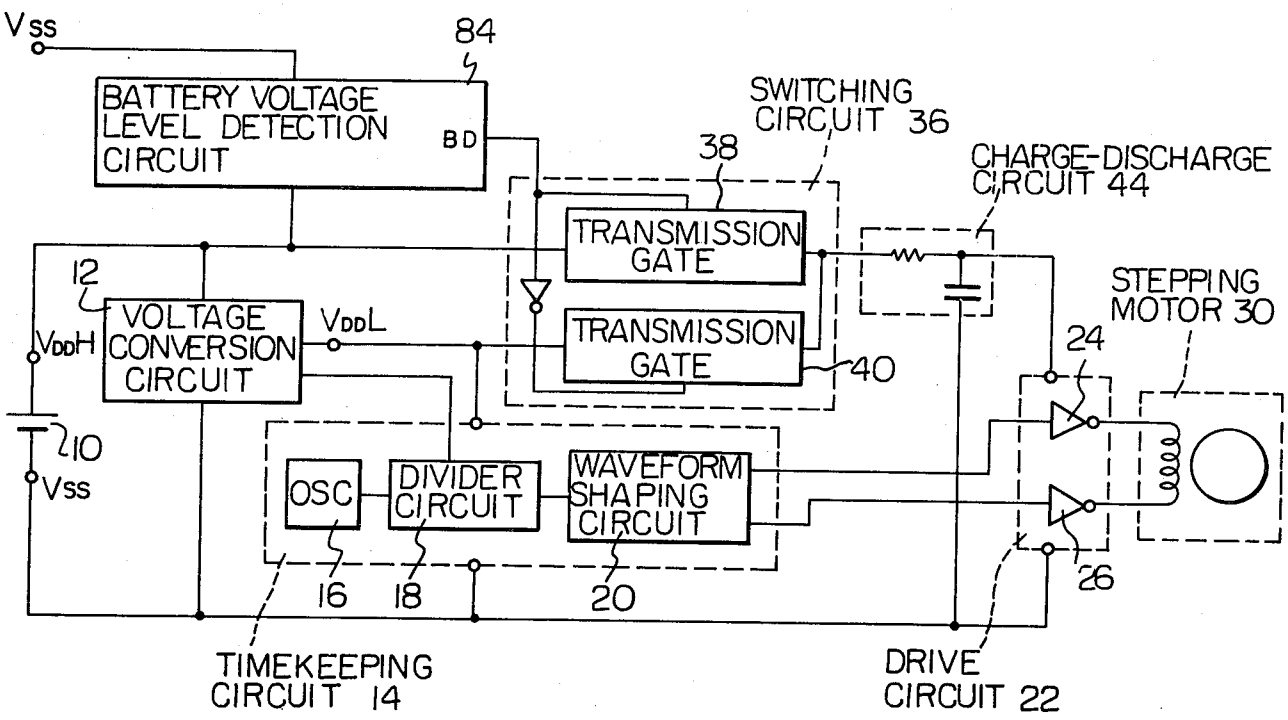
FIG. 5 shows a third embodiment of an electronic timepiece according to the present invention, in which the battery voltage level is detected, and the supply voltage applied to the stepping motor is altered in accordance with the battery voltage.

Referring now to FIG. 5, another embodiment of the present invention is shown therein. Numeral 84 denotes a battery voltage level detection circuit, which detects any drop in the voltage of battery 10 below a predetermined level, and produces a control signal when such a drop is detected. Normally, timekeeping circuit 14 and charge-discharge circuit 44 are supplied with the converted voltage supply $V_{ddL}$ from voltage conversion circuit 12, i.e. with a voltage which is of the order of one half of the battery voltage $V_{ddH}$. When battery voltage level detection circuit 84 detects a fall in the voltage of battery 10 below the predetermined level referred to above, then the control signal produced by battery voltage level detection circuit 84 is applied to the control input of switching circuit 36. As a result, switching circuit 36 disconnects the output voltage of voltage conversion circuit 12 from the input of charge-discharge circuit 44, and connects thereto the voltage of battery 10. Thus, a higher voltage is supplied to drive circuit 26 from charge-discharge circuit 44, thereby compensating for the drop in battery voltage which has been detected.

Such a drop in battery voltage can be caused for example by utilization of the timepiece at an excessively low ambient operating temperature or can result from the battery approaching the end of its usable life. In either case, the embodiment of FIG. 5 ensures that a sufficiently high supply voltage is applied to drive circuit 26 for ensuring reliable actuation of stepping motor 30 by the drive signal produced from drive circuit 26.

Figure 6:
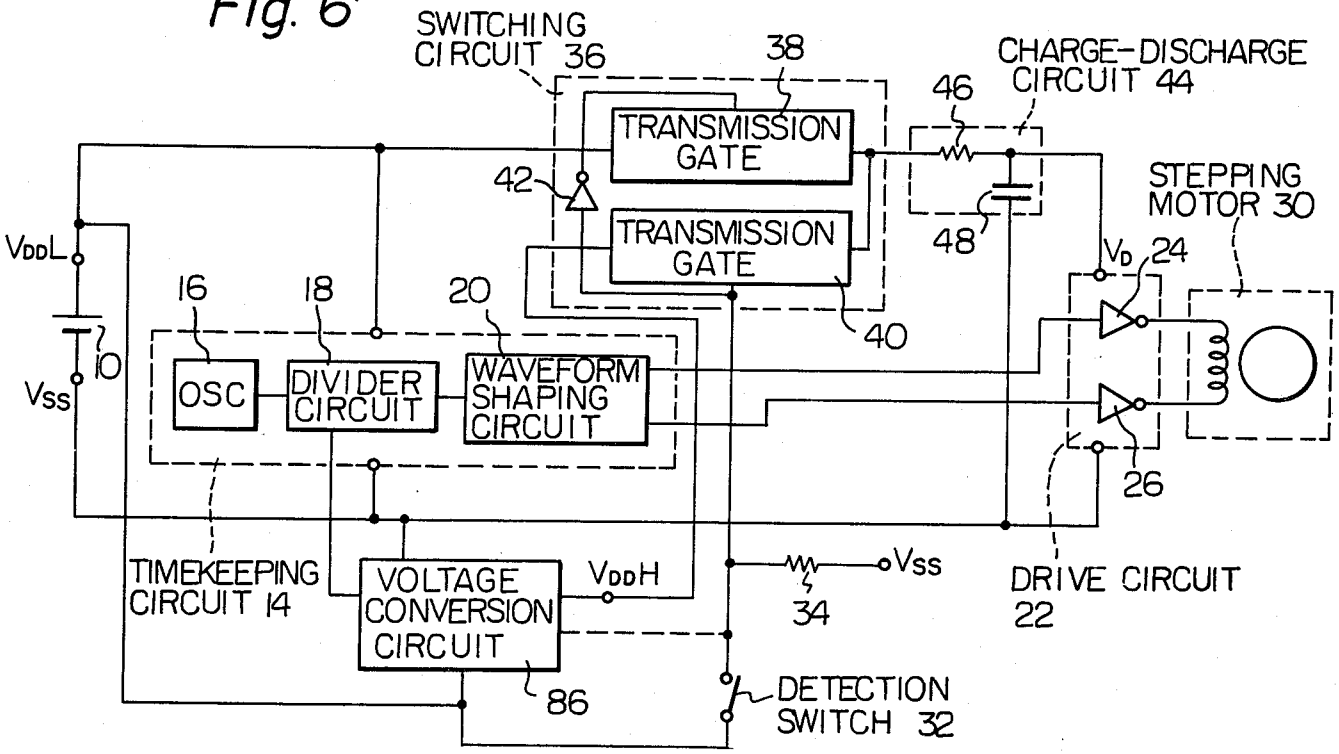
FIG. 6 shows another embodiment of the present invention, employing a voltage conversion circuit which performs a voltage boosting function.

Referring now to FIG. 6, another embodiment of the present invention is shown. As in the case of the embodiment shown in FIG. 1 and described hereinabove, reference numeral 32 denotes a detection switch which is closed at a point in time immediately prior to the days dial or date dial of the timepiece being advanced by stepping motor 30 through the wheel train of the timepiece. However in the case of the embodiment of FIG. 1, the voltage conversion circuit 12 produces an output voltage which is of the order of one half of the battery voltage. In the case of the embodiment of FIG. 6, voltage conversion circuit 86 is a voltage boosting circuit, which provides an output voltage that is higher than the battery voltage, for example of the order of twice the voltage of battery 10. This voltage, denoted as $V_{ddH}$ in FIG. 6, is applied to one input of a switching circuit 36, which receives the voltage of battery 10 at another input. When detection switch 32 is open, so that voltage $V_{ss}$ is applied to the control input of switching circuit 36, the voltage of battery 10, i.e. $V_{ddL}$, is applied through transmission gate 38 of switching circuit 36 to resistor 46 of charge-discharge circuit 44, since in this case transmission gate 38 is enabled and transmission gate 40 is transmission inhibited. When detection switch 32 closes, thereby applying a voltage $V_{ddL}$ to the control input of switching circuit 36, then transmission gate 40 becomes enabled and transmission gate 38 is inhibited, so that voltage $V_{ddH}$ from the output of voltage conversion circuit 86 is applied to resistor 46 of charge-discharge circuit 44. The voltage $V_{ddL}$ of battery 10 continues to be applied to supply the timekeeping circuit 14.

Thus, as in the case of the embodiment of FIG. 1, a higher voltage is applied to charge-discharge circuit 44, and hence to drive circuit 22, when detection switch 32 closes to indicate that a higher than normal load will be applied to motor 30 shortly subsequently. Hence, the same advantages are provided by the embodiment of FIG. 6 as by that of FIG. 1, i.e. the current supplied to drive the motor 30 can be set to suitable levels to ensure reliable operation under both normal and high load conditions applied to the motor, without an excessive level of current being supplied at any time.

It should be noted that any of the other embodiments of the present invention described herein, as shown in FIGS. 4 and 5, can be modified to employ a voltage boosting circuit as a voltage conversion circuit, as in the case of the embodiment of FIG. 6, rather than a voltage step-down circuit. In such a case, power would be supplied to charge-discharge circuit 44 directly from the battery 10 through switching circuit 36, under normal operation, and would be applied to the charge-discharge circuit from the output of the voltage conversion circuit when a requirement for a higher drive voltage to be applied to motor 30 is detected. In any such case, the basic principles of the present invention remain unchanged.

It should also be noted that such a voltage boosting circuit can be held in an inoperative condition until the higher voltage which it can supply is actually required. This is indicated by the broken line shown connecting switch 32 output terminal and voltage conversion circuit 86, in FIG. 6. This is important due to the fact that a high-efficiency low-power voltage conversion circuit as employed in an electronic timepiece generally employs dynamic switching of complementary field effect transistor elements. So long as steady-state voltages are applied to such elements, they draw a supply current which is virtually zero, and current is actually drawn from the supply source only when switching transitions of these field-effect transistor elements occur. Thus, if such a voltage conversion circuit is held in an inoperative condition, i.e. without switching transitions occurring within its circuitry, then virtually no current will be drawn from the battery by the voltage conversion circuit until the circuit is actually brought into use to supply a boosted voltage.

In the embodiment of the present invention illustrated in the drawings and described hereinabove, charge-discharge circuit 44 has been shown as composed of a capacitor 48 and a resistor 46. However, it is equally possible to replace resistor 46 by a transistor which is switched into a conducting state, thereby connecting the output of switching circuit 36 to capacitor 48, so long as a drive signal pulse is not being produced by drive circuit 26, and which is switched into a non-conducting state, thereby isolating the output of switching circuit 36 from capacitor 48, when a drive signal pulse is produced by drive circuit 26. This will ensure that any change in the voltage across capacitor 48 while a drive signal pulse is being produced will have no effect upon the supply voltage applied to timekeeping circuit 14.

It should also be noted that it is equally possible to omit the detection switch 32, drive voltage condition detection circuit 82 and battery voltage level detection circuit 84 of the embodiments of the present invention described hereinabove, and to replace these by a temperature detection device. This temperature detection device could detect a fall in ambient operating temperature below a predetermined level, and produce a control signal in response thereto, whereby the output of voltage conversion circuit 12 is disconnected from charge-discharge circuit 44 and the voltage of battery 10 is applied directly thereto. In this way, a drop in battery voltage due to excessively low ambient operating temperature can be compensated for, thereby ensuring reliable operation of the calendar mechanism of the timepiece under various conditions of operating temperature.

From the foregoing description, it will be apparent that the present invention enables optimum use of the available capacity of a battery in an electronic timepiece having an electromagnetic transducer such as a stepping motor. This is due to the fact that the present invention is based on the intermittent supply of power to the electromagnetic transducer, and, by means of a charge-discharge circuit, enables a voltage conversion circuit having a high output impedance to be used to supply power at some desired voltage level to drive the electromagnetic transducer. It should be noted that various circuits are known in the art whereby voltage conversion with a very high degree of conversion efficiency can be performed at extremely low levels of power. Such circuits can utilize complementary field effect transistors as switching elements, for example. However it is not practicable to produce such a voltage conversion circuit, providing a very high degree of conversion efficiency, which also has a low level of output impedance. It is for this reason that the charge-discharge circuit of the present invention represents a significant improvement over the prior art, since, in effect, the supply of drive power from the capacitor of the charge-discharge circuit in an intermittent manner, with the charge-discharge circuit being supplied with power from a voltage conversion circuit of high output impedance, provides the same practical effect as supplying the drive power for the electromagnetic transducer from a voltage conversion circuit of high efficiency and low output impedance.

Although the present invention has been shown and described with respect to particular embodiments, it should be noted that various changes and modifications to these embodiments are possible, which come within the scope claimed for the present invention.

What is claimed is:

1. An electronic timepiece powered by a battery, comprising:

timekeeping circuit means for producing a standard time signal;

drive circuit means responsive to said standard time signal for producing a display drive signal;

an electro-mechanical transducer driven intermittenly by said display drive signal;

time display means actuated by said electro-mechanical transducer to provide a display of time information;

detection means for detecting an operating condition of said electronic timepiece and providing a detection signal indicative thereof;

voltage conversion circuit means for converting an output voltage of said battery to provide a converted supply voltage, said converted supply voltage being different from the output voltage of said battery;

switching means coupled to receive the output voltage of said battery and said converted supply voltage, and responsive to said detection signal for selectively providing said battery voltage and said converted supply voltage at an output terminal thereof; and driving power supply means coupled to said output terminal of the switching means, said driving power supply means having output terminals coupled to said drive circuit means for providing a supply voltage thereto, said supply voltage being charged toward the output voltage of said switching means while said electronic timepiece is in an operating state in which power is being supplied only to said timekeeping circuit means, and said supply voltage being discharged by supplying power to said drive circuit means while said electromechanical transducer is being driven.

2. An electronic timepiece according to claim 1, in which said driving power supply means comprises a charge-discharge circuit including means for charging said supply voltage during an inoperative state of said electro-mechanical transducer and means for discharging said supply voltage during an operating state of said electro-mechanical transducer.

3. An electronic timepiece according to claim 2, in which said charging means comprises a capacitor.

4. An electronic timepiece according to claim 1, in which said battery comprises a lithium battery, and said voltage conversion circuit comprises a voltage dropping circuit.

5. An electronic timepiece according to claim 4, in which said timekeeping circuit is driven by said converted supply voltage.

6. An electronic timepiece according to claim 1, in which said voltage conversion circuit comprises a voltage boosting circuit.

7. An electronic timepiece according to claim 6, in which said voltage conversion circuit is enabled in response to said detection signal.

8. An electronic timepiece according to claim 1, in which said time display means comprises means for displaying current time and for displaying calendar information, and in which said detection means detects a condition in which said electro-mechanical transducer actuates said time display means to change said displayed calendar information, and produces said detection voltage indicative of said condition.

9. An electronic timepiece according to claim 8, in which said time display means for displaying calendar information includes a wheel train and cam means rotated thereby, and in which said detection means comprises a detection switch actuated by said cam means to thereby produce said detection signal.

10. An electronic timepiece according to claim 9, in which said cam means actuates said detection switch at a predetermined time prior to actuation of said time display means by said electro-mechanical transducer to change said displayed calendar information.

11. An electronic timepiece according to claim 1, in which said detection means comprises drive voltage condition detection means for detecting an alteration in the waveform of said display drive signal indicative that an increased load has been applied to said electro-mechanical transducer, and for producing a signal indicative of said alteration in display drive signal waveform, and timer means responsive to said signal indicative of display drive signal waveform alteration for producing said detection signal, said detection signal being produced by said timer means for a predetermined time duration following the initiation of said alteration in the display drive signal waveform.

12. An electronic timepiece according to claim 1, in which said detection means comprises circuit means for detecting an alteration in the voltage of said battery.

13. An electronic timepiece according to claim 1, in which said switching means comprises at least one transmission gate controlled by said detection signal.

* * * * *